US006162155A

United States Patent [19]

Gordon et al.

[11] Patent Number: 6,162,155

[45] Date of Patent: Dec. 19, 2000

[54] FOLDING SCORE AND METHOD AND APPARATUS FOR FORMING THE SAME

[75] Inventors: Kevin T. Gordon, Chisago City; Doyle C. Olson, Savage, both of Minn.

[73] Assignee: Jonco Die Company, Inc., Mounds View, Minn.

[21] Appl. No.: 09/295,706

[22] Filed: Apr. 21, 1999

[51] Int. Cl.[7] ..... B31B 1/25

[52] U.S. Cl. ..... 493/59; 493/60; 493/365; 493/396; 493/402

[58] Field of Search ..... 493/365, 59, 402, 493/403, 354, 355, 401, 400, 399, 398, 397, 60, 61, 62, 63, 64, 160, 161, 345, 404, 463, 464, 396, 966

[56] References Cited

U.S. PATENT DOCUMENTS

| | | | |
|---|---|---|---|
| 336,335 | 2/1886 | McDonald . | |
| 3,039,372 | 6/1962 | Bombard | 493/396 |
| 3,074,324 | 1/1963 | Nobbe | 493/402 |
| 3,526,566 | 9/1970 | McIlvain, Jr. et al. | 493/396 |
| 3,552,244 | 1/1971 | Smith | 493/60 |
| 3,564,942 | 2/1971 | Wolfe | 493/60 |
| 3,735,674 | 5/1973 | Haddock | 493/354 |
| 3,946,627 | 3/1976 | Hofmann . | |
| 4,224,851 | 9/1980 | Imai . | |
| 4,437,850 | 3/1984 | Ono . | |
| 4,499,802 | 2/1985 | Simpson . | |
| 5,002,524 | 3/1991 | Mills . | |
| 5,067,193 | 11/1991 | Thomas . | |
| 5,073,162 | 12/1991 | Campbell et al. | 493/354 |
| 5,111,725 | 5/1992 | Simpson et al. . | |
| 5,194,064 | 3/1993 | Simpson et al. | 493/402 |
| 5,221,249 | 6/1993 | Simpson . | |
| 5,429,577 | 7/1995 | Simpson et al. . | |
| 5,466,211 | 11/1995 | Komarek et al. . | |
| 5,582,571 | 12/1996 | Simpson et al. . | |
| 5,641,551 | 6/1997 | Simpson et al. . | |
| 5,690,601 | 11/1997 | Cummings et al. . | |

*Primary Examiner*—Peter Vo
*Assistant Examiner*—Louis Huynh
*Attorney, Agent, or Firm*—Dorsey & Whitney LLP

[57] ABSTRACT

A folding score and a method and apparatus for forming the folding score which includes a pair of longitudinally extending and laterally spaced side scores and a plurality of longitudinally spaced cross scores positioned therebetween. The apparatus for forming the folding score includes a creasing rule or a die board embodying a creasing rule with a pair of laterally spaced score members and a plurality of longitudinally spaced cross score members positioned therebetween.

16 Claims, 4 Drawing Sheets

FOLDING SCORE AND METHOD AND APPARATUS FOR FORMING THE SAME

BACKGROUND OF THE INVENTION

1. Field of the Invention

The present invention relates generally to a folding score and a method and apparatus for forming such folding score. More particularly, the present invention relates to a folding score and a method and apparatus for forming such folding score in a panel of sheet material such as corrugated paperboard or the like.

2. Description of the Prior Art

The processing of sheet material to transform such sheet material to a useable form such as a box, display device or the like, normally involves utilizing a rotary die or flat die to cut a blank from the sheet material and provide it with various scores, slits, etc. for the purpose of forming tear strips, punch outs, fold lines, etc. in the blank. These cuts, scores, slits, etc. are commonly formed through the use of cutting and creasing rules mounted into or onto the die.

To facilitate folding of sheet material such as corrugated paperboard, fold lines are formed in the material by scoring dies commonly referred to as creasing rules. In the past, various configurations of folding lines or folding scores have existed including, among others, a single score in which the sheet material is compressed or creased along a single line, a double score in which the material is compressed or creased along a double, parallel line, a wavy score such as that reflected in U.S. Pat. No. 5,221,249 in which the material is compressed or creased along a wavy line, a broken score in which the material is compressed or creased along a single or double line with intermittent areas of non-compression, and a slit score in which portions of the material are cut along a single or double line, with areas where the material is not cut.

A problem which has existed and continues to exist with respect to corrugated paperboard folds, and particularly corrugated paperboard folds along a line substantially parallel to the corrugation flutes, is the tendency of the fold lines to "wander" and not fold consistently. Specifically, fold lines formed with existing score configurations or creasing rules are susceptible to shifting to one side or the other during the actual folding process, thereby resulting in "phantom" fold lines which are laterally spaced from the intended fold line or resulting in a fold which is not completely straight or square.

One effort to solve this problem is described in U.S. Pat. No. 5,194,064. This patent discloses a single, elongated primary score and a plurality of elongated creasing members that extend laterally outwardly from opposite sides of the primary score. This score, however, is significantly wider than conventional scores, thus resulting in a significant amount of the corrugated sheet material being compressed. This not only limits the use of this score mechanism to fold lines which are significantly spaced from one another, but also results in decreasing the strength of the sheet material along the fold line as a result of the excess crushing of the corrugation flutes.

Accordingly, there is a need in the art for a folding score for a sheet material such as corrugated paperboard or the like which provides for a consistent fold of the corrugated material along the fold line and precludes or minimizes the tendency of the fold line to wander or shift to one side or the other of the intended fold line. There is also a need in the art for an apparatus and method for forming such a folding score.

SUMMARY OF THE INVENTION

In contrast to the prior art, the present invention relates generally to a folding score for use in connection with a sheet material such as corrugated paperboard and which facilitates a fold which is consistent and which does not wander or shift from the intended fold line. Accordingly, the folding score of the present invention results in a fold in which the straightness and squareness is significantly enhanced. The invention also relates to an apparatus in the form of a creasing rule or a die for forming the folding score of the present invention as well as a method of forming the folding score on a foldable sheet material such as corrugated paperboard or the like.

More specifically, the folding score in accordance with the present invention is comprised of a pair of longitudinally extending, laterally spaced score lines with a plurality of cross score lines or portions positioned between the spaced score lines. It has been found that this particular folding score results in a fold which is highly consistent, which does not result in the fold shifting or wandering from the intended fold line and which thus results in a fold which is substantially straight and square. Further, this fold is substantially straight and square throughout the entire folding range from 0° to 180°. Although applicants do not wish to be bound by any particular theory, the reason for the improved quality of the fold with the present invention is believed to relate to the plurality of cross scores between the pair of spaced scores. Specifically, it is believed that these cross scores direct the fold to the outside crease or fold points defined by the pair of spaced scores, thereby resulting in substantially straight line folds. In contrast, folds using folding scores of the prior art fold along lines at the weakest point. In some cases this is along the intended fold line, while in other cases it is at a point between a pair of score lines or to one side or the other of a score line.

The invention also relates to a device or apparatus for forming the above described folding score. One such device includes a creasing rule which is designed for mounting to or use with a die board for use in either a rotary or flat die. Such creasing rule includes a pair of longitudinally extending first and second score members which are laterally spaced from one another and a plurality of cross score members positioned therebetween. Each of these score members includes a creasing edge which engages and compresses or creases the sheet material to form the folding score of the present invention.

A further apparatus for forming the folding score of the present invention includes a die board having one or more creasing rules such as that described above. Such a die board would normally be utilized in conjunction with a flat or rotary die to cut a blank from a panel of sheet material and provide scores for fold lines and the like.

The method aspect of the present invention generally includes forming a fold line in a sheet material such as corrugated paperboard or the like by forming a pair of spaced score lines and a plurality of cross score lines or portions between the spaced score lines.

Accordingly, it is an object of the present invention to provide an improved folding score for a foldable sheet material resulting in a substantially straight, square and consistent fold in which the actual fold does not wander or shift from the intended fold line.

Another object of the present invention is to provide a folding score comprised of a pair of spaced score lines and a plurality of cross score lines or portions between the pair of spaced score lines.

A further object of the present invention is to provide a creasing rule for forming the folding score described above.

A still further object of the present invention is to provide an apparatus for forming the above described folding score utilizing a rotary die or a flat die.

A still further object of the present invention is to provide a method of forming a folding score as described above which includes a pair of spaced score lines and a plurality of cross scores positioned therebetween.

These and other objects of the present invention will become apparent with reference to the drawings, the description of the preferred embodiment and the appended claims.

DESCRIPTION OF THE PREFERRED EMBODIMENT

The present invention relates to an improved folding score for a sheet material and an apparatus and method for forming the same. Although the present invention has particular applicability to sheet material commonly referred to as corrugated cardboard or paperboard, it also has potential applicability for paperboard which is not corrugated and various other forms of sheet material which is foldable or made to be foldable. Thus, unless otherwise specified, the term "sheet material" as used herein shall mean any sheet material with which the present invention is usable including, but not limited to corrugated paperboard, non-corrugated paperboard and the like.

The apparatus for forming the folding score of the present invention, and in particular the creasing rule and the die board can be utilized with what is commonly referred as a rotary die or a flat die or any other form of die. The description of the preferred embodiment, however, will be with reference to a rotary die. In the preferred embodiment, the folding score of the present invention is shown as forming a fold line in corrugated paperboard stock which runs parallel to the corrugation flutes. Although the folding score of the present invention has particular applicability in folding a corrugated sheet material in a direction parallel to the corrugation flutes, it also has applicability to forming fold lines in corrugated sheet material in a direction perpendicular or diagonal to the flutes or to sheet material without corrugation flutes.

Figure 1:
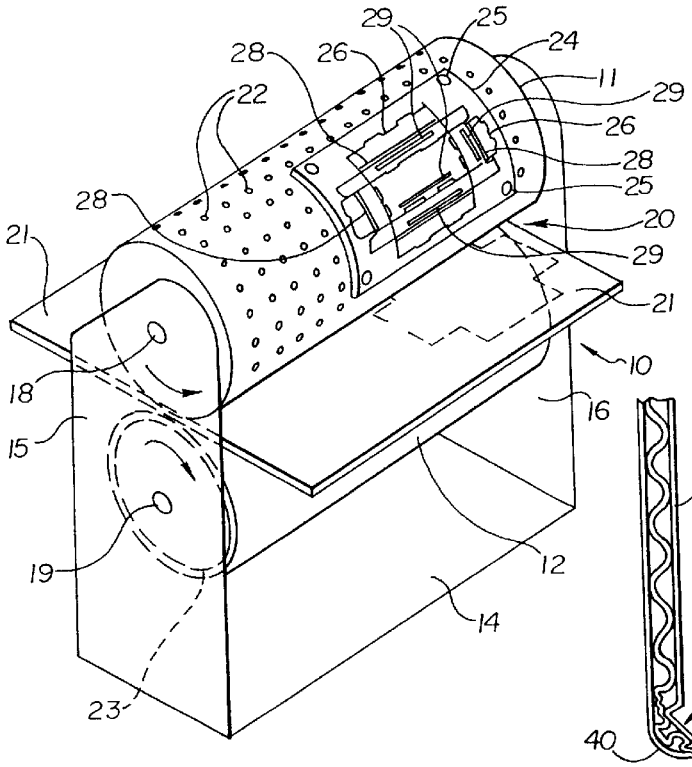
FIG. 1 is an isometric view of a rotary die embodying a die board and creasing rule for forming the folding score in accordance with the present invention.

In describing the present invention, reference is first made to the FIG. 1 which shows a conventional rotary press 10 embodying a die board with a creasing rule of the present invention as hereafter described. The rotary press 10 of FIG. 1 includes a die roll or cylinder 11, an anvil roll 12 and a support structure comprising a base 14 and a pair of side supports 15 and 16. As shown, the die and anvil rolls 11 and 12 are rotatably mounted in the side supports 15 and 16 about their respective rotation axes 18 and 19. During operation, the rolls 11 and 12 rotate about their axes 18 and 19 in opposite directions as shown by the directional arrows.

The rolls 11 and 12 are adjacent to one another as shown, but are slightly spaced to define a nip 20 between them through which a panel of sheet material 21 passes during operation. This panel of sheet material 21 is preferably corrugated paperboard having parallel flutes or corrugations extending is a single direction. Normally, the panel 21 is fed through the nip 20 between the rollers 11 and 12 in a direction generally parallel to or perpendicular to the corrugations, however, it can be fed through diagonally as well.

The die roll 11 is a right cylindrical metal roller having a plurality of internally threaded mounting holes 22 extending axially across and circumferentially around the roll 11. The anvil roll 12 is also a generally right cylindrical member having a core portion constructed of metal. It is common for the anvil roll 12 to be provided with an external cutting blanket 23 constructed of urethane or a similarly compressible material. In some applications, however, an anvil roll with a steel exterior is utilized.

A die board comprised of a die base 24 and a plurality of cutting and creasing rules and scrap ejector elements is securely mounted to the die roll 11 by a plurality of externally threaded members 25 such as bolts threadedly received in the mounting holes 22. The die base 24 is conventionally constructed of a material such as plywood and has a curvature substantially matching the curvature of the exterior surface of the roll 11. The die base 24 normally has a thickness ranging from about ⅜ to about ⅝ of an inch, but other thickness can be used as well. A plurality of cutting, creasing, slitting or other rules are mounted to the die base 24 to perform desired operations on the sheet material 21. In the embodiment of FIG. 1, the die board is provided with a plurality of cutting rules 26 for cutting the sheet material 21 into a product blank and a plurality of creasing rules 28 for forming folding scores on the product blank cut from the sheet material 21 in accordance with the present invention. Also, mounted to the die base 24 in a manner known in the art are a plurality of product or scrap ejection elements 29 in the form of pieces of compressible material adjacent to the cutting and creasing rules 26 and 28. These elements 29 force the product and scrap material away from each other and outwardly and away from the die roll 11 and the die base 24 during the cutting and creasing process.

The general structure of the rotary die of the rotary press illustrated in FIG. 1 is conventional and known in the art. During operation, the die and anvil rolls 11 and 12 rotate in the direction of the indicated arrows and the panel of sheet material 21 is fed into the nip 20 between the rollers. As the rules 26 and 28 of the die board engage the sheet material 21, the sheet material is cut into a product blank having a desired configuration and folding scores are formed on the product blank at desired locations.

Figure 2:
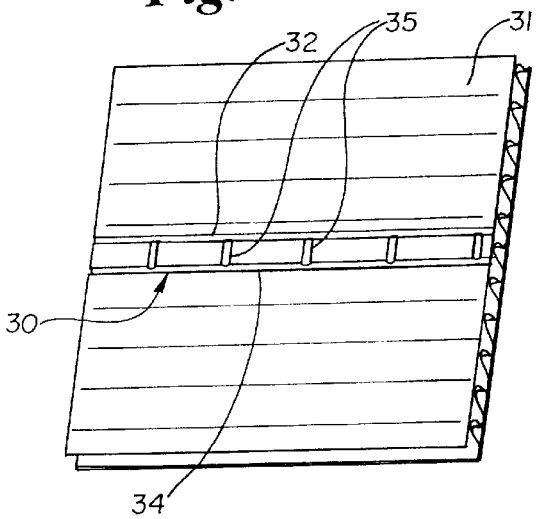
FIG. 2 is an isometric view of a section of corrugated paperboard material showing the folding score of the preferred embodiment.
Figure 13A:
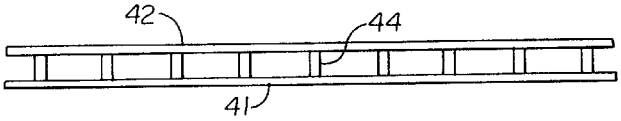
FIG. 13*a* shows the folding score of the preferred embodiment while FIGS. 13*b,* 13*c,* and 13*d,* 13*e* and 13*f* show various alternate embodiments of the folding score of the present invention.
Figure 13B:
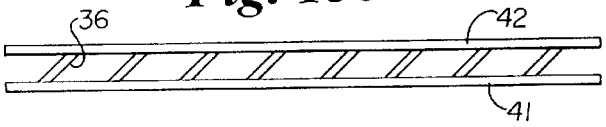
Figure 13C:
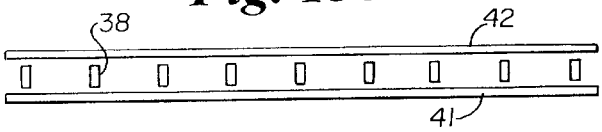
Figure 13D:
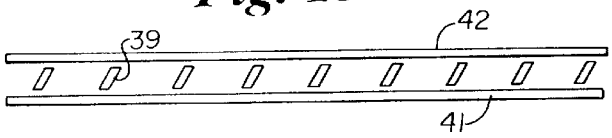
Figure 13E:
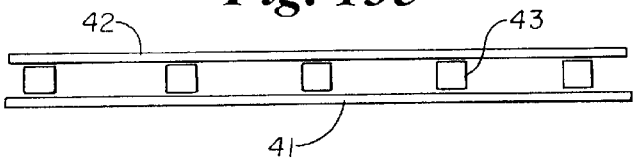
Figure 13F:
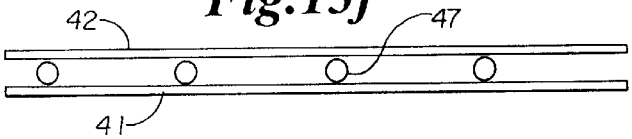

Reference is next made to FIG. 2 showing the folding score 30 of the present invention on a section of corrugated paperboard 31. As shown, the folding score 30 in accordance with the present invention comprises a "ladder" configuration and includes a pair of outer or side score lines in the form of a first score line 32 and a second score line 34. These score lines 32 and 34 extend longitudinally and are spaced laterally from one another. A plurality of third or cross score lines 35 extend between the pair of score members 32 and 34. In the preferred embodiment shown in FIG. 2 and in FIG. 13*a,* the cross scores 35 are closely adjacent to the pair of folding scores 32 and 34 so that they are essentially integral with the scores 32 and 34. In the preferred embodiment, the cross scores 35 are also oriented such that they are positioned substantially perpendicular to the score lines 32 and 34. It is contemplated, however, that a variety of other configurations of cross scores would also provide the benefits of the present invention. For example, the cross score members could be disposed at an angle other than 90° relative to the side score members and/or the cross score members could be spaced inwardly from the side score members. Also, the cross score members could have thicknesses greater or less than the thicknesses of the side score members, and shapes other than rectangular. FIGS. 13*b*–13*f* show some of these other embodiments. Specifically, FIG. 13*b* illustrates a modified embodiment in which the cross scores 36 are oriented at an angle other than 90° relative to the side score members 41 and 42. FIG. 13*c* shows the cross score members 38 oriented perpendicular to the score members 41 and 42, but spaced inwardly therefrom, while FIG. 13*d* illustrates a configuration in which the cross score members 39 are oriented at an angle relative to the score members 41 and 42 and are spaced inwardly therefrom. FIGS. 13*e* and 13*f* show the cross score members 43 and 47 having thicknesses significantly larger than the thicknesses of the side score members 41 and 42 and of different configurations.

Figure 3:
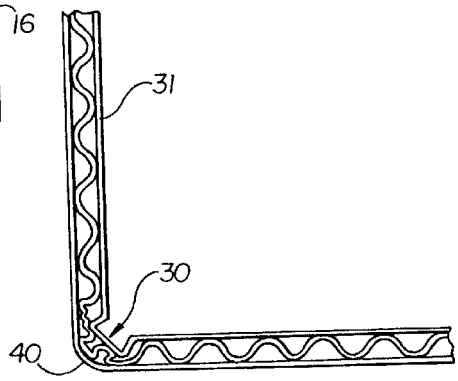
FIG. 3 is an end view of a section of corrugated paperboard folded along the folding score of the present invention at 90°.
Figure 4:
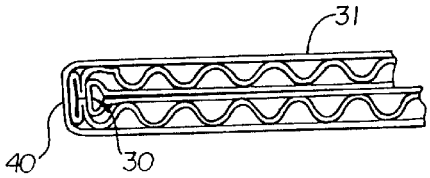
FIG. 4 is an end view of a section of corrugated paperboard folded along the folding score of the present invention at 180°.
Figure 5:
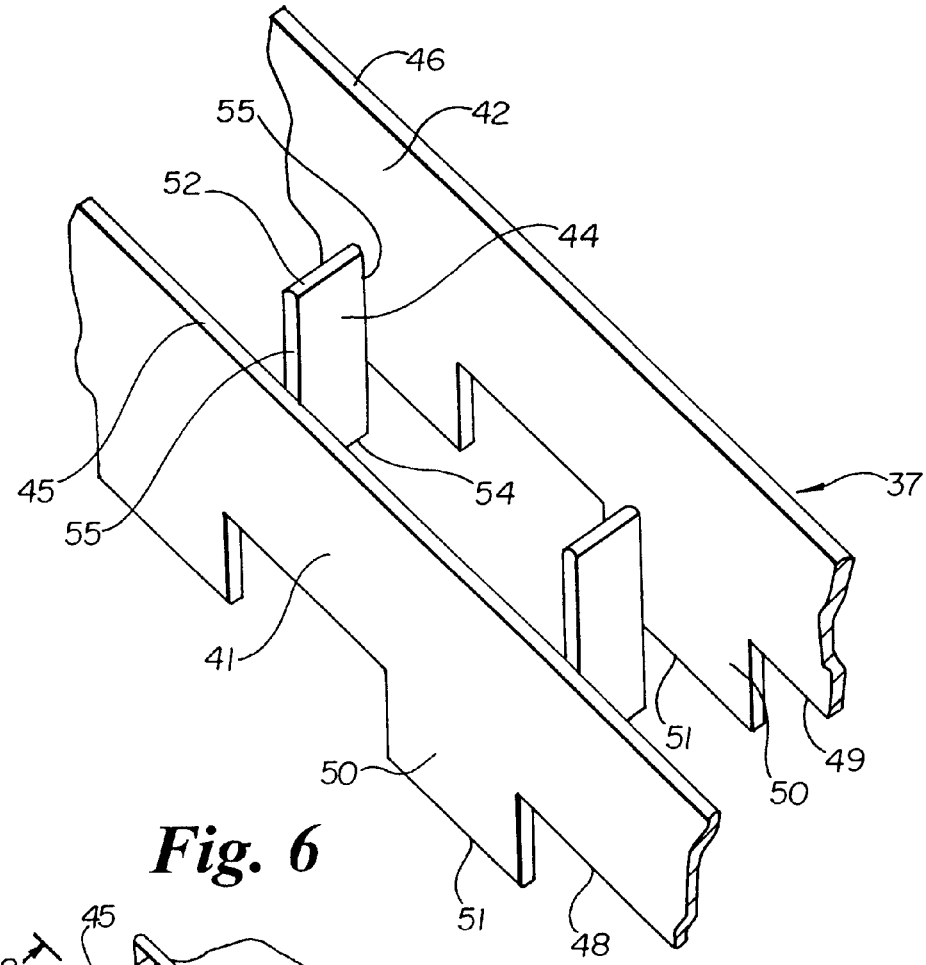
FIG. 5 is an isometric, exploded view of a section of a creasing rule for forming the folding score of the present invention.
Figure 6:
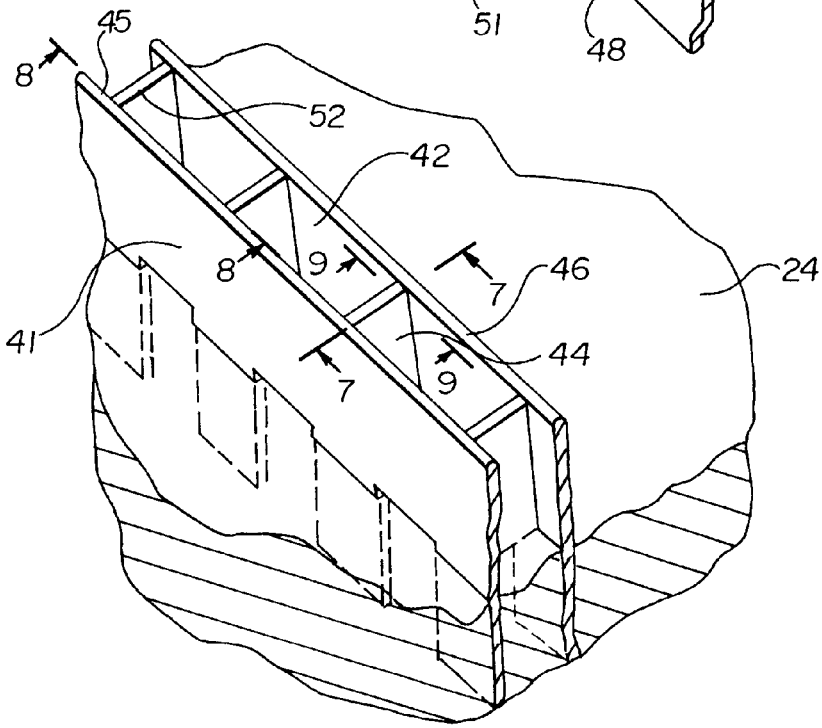
FIG. 6 is an isometric view of a section of the creasing rule for of the present invention mounted to a die board.

When the corrugated sheet material is folded along the folding score 30 as shown in FIGS. 3 and 4, the folding score 30 is to the inside of the fold and results in a consistent fold with a corner 40 which is substantially straight and square along its entire length. Further, with the folding score 30 of the present invention, the corrugated material 31 can be folded through the entire range of folds from 0° to 180° with a minimal amount of pressure or force urging the material 31 back toward a flat, unfolded position. This is a distinct improvement over currently existing folding scores.

Reference is next made to FIGS. 5, 6, 7, 8 and 9 showing various views of the creasing rule 37 of the present invention which is used to form the folding score 30 (FIG. 2). The creasing rule 37 of FIG. 5 includes a pair of first and second score members 41 and 42 which extend longitudinally and which are spaced laterally along their length. In the preferred embodiment, the members 41 and 42 are substantially parallel to one another and thus are equally laterally spaced from one another along the entire length of the rule 37. As shown, a plurality of third or cross score members 44 are positioned between the score members 41 and 42. In the preferred embodiment, these cross score members 44 are longitudinally spaced from each other along the length of the score member 41 and 42 and are oriented such that they are closely adjacent to and substantially perpendicular to the score members 41 and 42.

Figure 10:
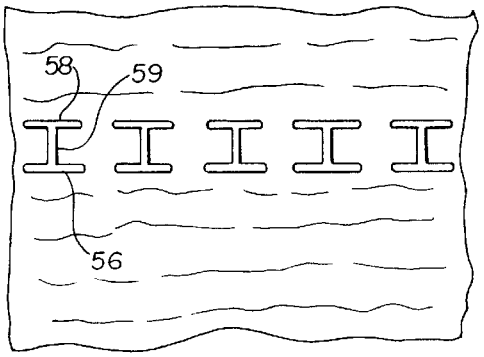
FIG. 10 is an elevational plan view of a section of a die board, without cutting or creasing rules, showing the mounting slits for the creasing rule of the present invention.

Each of the side or parallel score members 41 and 42 is provided with a top or creasing edge 45 and 46 and a bottom or support edge 48 and 49, respectively. A plurality of mounting tabs 50 extend downwardly from the bottom edges 48 and 49 These mounting tabs 50 include a bottom support edge 51 and are designed for insertion into mounting slots 58 and 59 in the die board 24 (FIG. 10). Each of the score members 41 and 42 is substantially planar and continuous throughout and is constructed of steel, although other materials will work as well. Preferably, the thickness of the score members 41 and 42 ranges from about 0.028 to 0.102 inches (2 to 8 points), depending upon the thickness of the crease desired in the sheet material. The members 41 and 42, however, must be sufficiently thick and rigid to withstand the compressive forces created during the creasing process.

The cross score members 44 are also substantially planar throughout and include a top creasing edge 52, a substantially parallel bottom support or mounting edge 54 and a pair of substantially parallel side edges 55. Similar to the score members 41 and 42, the generally rectangular score member 44 is constructed of steel, although other materials will work as well. The thickness of the members 44 in the configuration of the preferred embodiment will vary with their desired configuration. Preferably, however, their thickness will range from about 0.028 to 0.102 inches (2 to 8 points), but will have sufficient thickness and rigidity to withstand the creasing forces. In some embodiments it is contemplated that the score members 44 as well as the score members 41 and 42 could be constructed of other materials such as aluminum or hard plastics such as Nylon.

The preferred and alternate embodiments described above show the pair of side score members 41 and 42 being substantially continuous throughout their length. However, benefits of the present invention can be achieved with embodiments where the side score members are not continuous, but are comprised of sections which are longitudinally spaced. It is preferred however that each section of side score members includes at least one, and preferably more than one of the cross score members 44.

FIGS. 6, 7, 8 and 9 show the creasing rule 37 of the preferred embodiment as mounted in a die base 24 of the type illustrated best in FIG. 10. As shown in FIG. 10, a plurality of mounting slots are provided for the purpose of rigidly and securely mounting the score members 41, 42 and 44 to the base 24. Specifically, the mounting slots include a first series of slot portions 56 which are substantially linearly aligned and spaced from one another and a second series of slot portions 58 also substantially linearly aligned and spaced from one another. Preferably, the first and second series of slot portions 56 and 58 are substantially parallel to one another and are generally laterally aligned with respect to one another. A third series of mounting slots or slot portions 59 extend between the first and second series of slot portions 56 and 58 and are substantially perpendicular to such slot portions 56 and 58 as shown. In the manufacturing process for the die base 24, the mounting slots 56, 58 and 59 are cut using laser technology, although other cutting techniques may be used as well.

Figure 7:
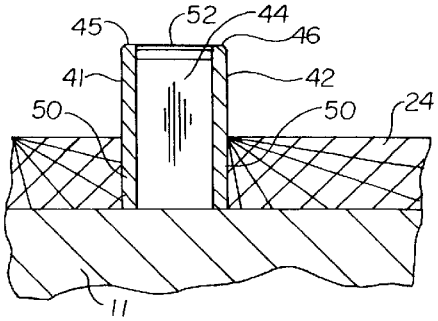
FIG. 7 is a view, partially in section, as viewed along the section line 7—7 of FIG. 6.
Figure 8:
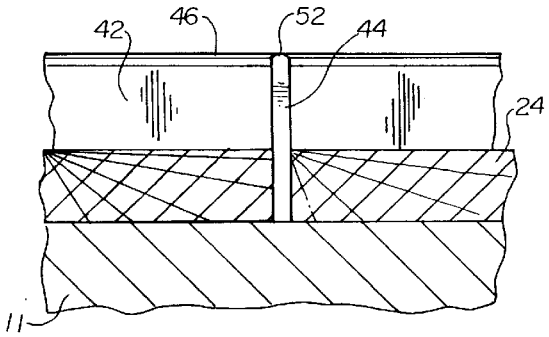
FIG. 8 is a view, partially in section, as viewed along the section line 8—8 of FIG. 6.
Figure 9:
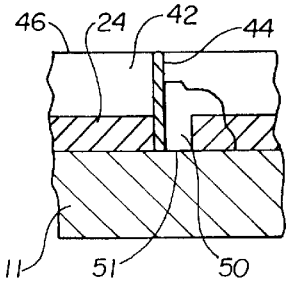
FIG. 9 is a view, partially in section, as viewed along the section line 9—9 of FIG. 6.

When the creasing rule of the present invention is assembled, the mounting tabs 50 on the score members 41 and 42 are inserted into the slot portions 56 and 58, respectively, and the cross score members 44 are inserted into slot portions 59. Following initial insertion manually, the score members 41, 42 and 44 are fully inserted into their respective slot portions 56, 58 and 59 using a mallet or the like. When fully inserted, the bottom mounting edge 51 of the score members 41 and 42 and the bottom mounting edge 54 of the cross score members 44 engage and are supported against the outer metal surface of the die roll 11 as shown in FIGS. 7, 8 and 9.

Figure 14:
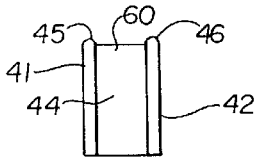
FIG. 14 is an end view of an alternate embodiment of the creasing rule in accordance with the present invention.

In the preferred embodiment of FIGS. 5–9, the top creasing edges 52 of the cross score members 44 are at substantially the same height or level as the creasing edges 45 and 46 of the score members 41 and 42. However, this is not a necessity. If desired, the creasing edge 52 can be higher or lower than the creasing edges 45 and 46, depending upon the amount of crease desired for the cross scores 35 of the folding score 30 (FIG. 2). An example of an alternate embodiment of a cross score member 44 is shown in FIG. 14, in which the creasing edge 60 is lower than the creasing edges 45 and 46. To be functional, however, the creasing edge of the cross score members 44 must be sufficiently high relative to the edges 45 and 46 so that they contact at least a portion of the sheet material during the cutting and scoring process. Further, although the preferred embodiment shows the side score members 41 and 42 separate from the cross score members 44, it is contemplated that a creasing rule could be formed in which the score members 41 and 42 are integrally formed or connected with the cross score members 44 by various forming or welding techniques, among others.

Figure 11:
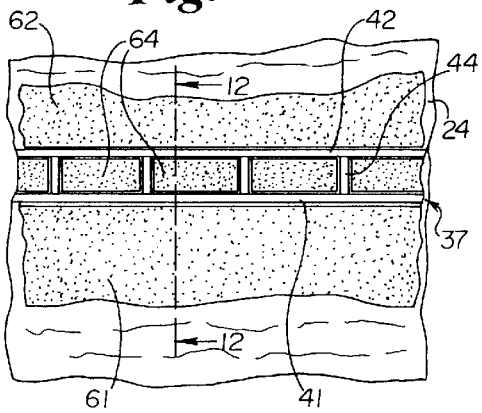
FIG. 11 is an elevational plan view of a section of die board with the creasing rule of the present invention and ejection members mounted thereon.

Cutting, creasing, slitting and other forms of rules used with rotary and flat dies are commonly provided with product and scrap ejector means for forcing scrap material from the product and for urging the scrap and material away from the die board and the various die or rule components. A variety of such means currently exists in the art. These ejector means may comprise portions of compressible material secured to the die board adjacent to the cutting and creasing rules or may comprise various forms of compressible spring or other members similarly located to accomplish the above-mentioned functions. In the preferred embodiment, it is contemplated that the product and scrap ejector means would comprise a compressible material such as open or closed cell sponge or ejection rubber of the type commonly used for this purpose. FIG. 11 shows a section of a die board with the creasing rule 37 of the present invention assembled and mounted to the base 24 and product and scrap ejector means in the form of a plurality of pieces of compressible material. Specifically, the pieces of compressible material comprise portions 61 and 62 which are mounted adjacent to the outer surfaces of the score members 41 and 42 and a plurality of substantially rectangular solid portions 60 mounted between the score members 41 and 42 and between adjacent cross score members 44 as shown. In some applications, the ejection materials may be eliminated from the area between the score members 41 and 42 and between adjacent score members 44.

Figure 12:
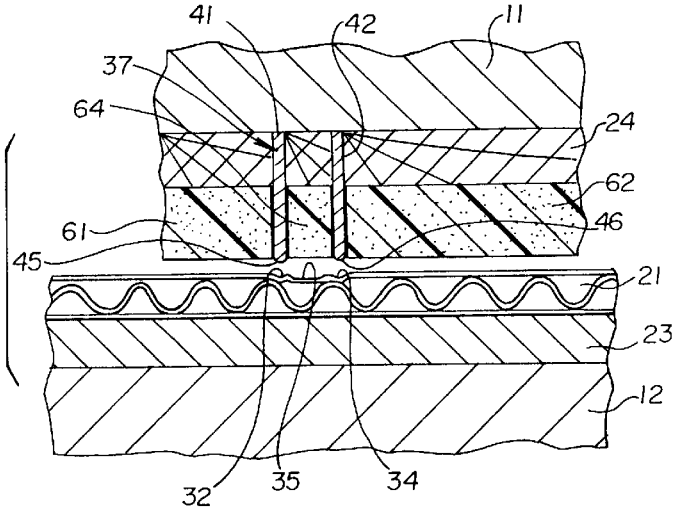
FIG. 12 is a view, partially in section and with portion broken away, showing the relationship between a piece of corrugated paper board and the creasing rule of the present invention during the formation of the folding score.

FIG. 12 shows the relationship between the die and anvil rolls 11 and 12 and the creasing rule of the present invention immediately following a scoring process. As shown, during the process, the off side or non-creasing side of the sheet material 21 is supported by the cutting blanket 23 mounted on the anvil roll 12, while the die board including the die base 24, the creasing rule 37 of the present invention and the ejector materials 61, 62 and 64 are mounted to the metal die roll 11. During the scoring process, the sheet material 21 is creased or scored to form the substantially parallel score lines 32 and 34 and the plurality of cross score lines 35.

Figure 15:
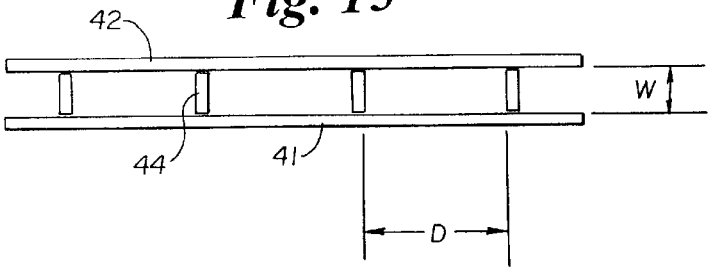
FIG. 15 is an elevational view of the folding score showing the spacing relationship between the side score members and the cross score members.

FIG. 14 illustrates the dimensional relationship between the side score members 41 and 42 and the score members 44. Specifically, it is contemplated that the distance between the side score members 41 and 42 as well as the distance between the cross score members 44 may vary depending upon the particular sheet material being utilized, the thicknesses of the score members, the desired depth of the score lines as well as other factors. Preferably, for single and double wall fluted (corrugated) material, it is expected that the distance "W" as shown in FIG. 15 between the score members 41 and 42 will range from about 0.125 to 1.5 inches, with the preferred distance being about 0.2 to 0.5 inches. For such distances "W", it is expected that the distance "D" between the cross score members would range from about 0.125 to 1.5 inches, and preferably from about 0.25 to 0.75 inches. As a relationship between the distance "W" and the distance "D", it is preferred that the distance "D" be no greater than about five times the distance "W", more preferably no greater than about three times the distance "W", and most preferably about one to three times the distance "W".

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A creasing rule for use in forming a fold line in sheet material comprising:

first and second score members extending longitudinally and being spaced laterally from one another and a plurality of third score members positioned between said first and second score members for scoring the sheet material wherein said third score members are longitudinally spaced.

2. The creasing rule of claim 1 wherein said third score members are longitudinally spaced from one another and extend from said first score member to said second score member.

3. The creasing rule of claim 1 wherein said third score member is substantially perpendicular to said first and second score members.

4. The creasing rule of claim 1 wherein each of said first, second and third score members includes a creasing edge and each of said creasing edges is at substantially the same level.

5. The creasing rule of claim 1 wherein said first, second and third score members are integrally connected with one another.

6. The creasing rule of claim 1 wherein each of said first and second score members includes a creasing edge, a plurality of a spaced base edge portions and a plurality of mounting portions extending outwardly between said base edge portions.

7. The creasing rule of claim 6 wherein each of said third score members includes a mounting portion.

8. A die for use in forming a plurality of fold lines in sheet material comprising:

a die board and one or more creasing rules mounted to said die board to form said plurality of fold lines, at least one of said creasing rules for forming one of said plurality of fold lines comprising:

first and second score members extending longitudinally and being spaced laterally from one another and a plurality of third score members positioned between said first and second score members for scoring the sheet material wherein said third score members are longitudinally spaced.

9. The die of claim 8 including one or more cutting rules mounted to said die board.

10. The die of claim 8 wherein said die board includes a plurality of mounting slots.

11. The die of claim 10 wherein each of said one or more creasing rules includes mounting portions for insertion into and mounting engagement with said mounting slots.

12. The die of claim 10 wherein said plurality of mounting slots includes a first series of substantially linear mounting slots, a second series of substantially linear corresponding mounting slots laterally spaced from said first series of mounting slots and a plurality of cross mounting slots extending between the mounting slots of said first series and the corresponding mounting slots of said second series.

13. The die of claim 8 including a sheet material ejector positioned between adjacent third score members.

14. The die of claim 13 wherein said sheet material ejector includes a compressible material.

15. A creasing rule for use in forming a fold line in sheet material comprising:

first and second score members extending longitudinally and being spaced laterally from one another to define a fold line area between said first and second score members and a plurality of third score members positioned in said fold line area between said first and second score members for scoring the sheet material wherein said third score members are longitudinally spaced, said plurality of third score members being confined to said fold line area and not extending laterally beyond said fold line area.

16. The creasing rule of claim 15 for forming one of a plurality of fold lines in sheet material.

* * * * *